United States Patent [19]

Minakuchi

[11] Patent Number: 4,882,578

[45] Date of Patent: Nov. 21, 1989

[54] CHARACTER DISPLAY DEVICE

[75] Inventor: Akihiro Minakuchi, Tokyo, Japan

[73] Assignee: Oki Electric Industry Co., Ltd., Tokyo, Japan

[21] Appl. No.: 167,157

[22] Filed: Mar. 11, 1988

[30] Foreign Application Priority Data

Mar. 16, 1987 [JP] Japan ..... 62-59075

[51] Int. Cl.[4] ..... G09G 1/00

[52] U.S. Cl. ..... 340/750; 340/799

[58] Field of Search ..... 340/750, 748, 798, 799; 341/26

[56] References Cited

U.S. PATENT DOCUMENTS

| | | | |
|---|---|---|---|
| 4,203,102 | 5/1980 | Hydes | 340/750 |
| 4,433,330 | 2/1984 | Furjanic | 340/750 |
| 4,502,039 | 2/1985 | Vercesi et al. | 341/26 |
| 4,703,317 | 10/1987 | Shiomi et al. | 340/750 |

OTHER PUBLICATIONS

Hinshu ga Hirogaru 1M bit Hin "More Types of 1 Mbit Devices", Nikkei Electronics No. 431, Oct. 5th, 1987, pp. 116–122.

*Primary Examiner*—Alvin Oberley
*Attorney, Agent, or Firm*—Spencer & Frank

[57] ABSTRACT

In a character display device for displaying characters on a display screen of a display unit (6): a refresh memory (2) stores character codes for respective display positions on the display screen; the refresh memory is supplied with addresses and thereby to sequentially produces character codes; a character generator (4) receives the character codes from the refresh memory and produces pixel signals representing character patterns of the character codes; a frame memory (8) receives and stores the pixel signals for display positions of the respective pixels; the frame memory is supplied with addresses and thereby sequentially produces pixel signals; and the display unit displays the pixel signals from the frame memory on the display screen.

7 Claims, 3 Drawing Sheets

CHARACTER DISPLAY DEVICE

BACKGROUND OF THE INVENTION

This invention concerns a character display device, in particular a device for display of characters on high-resolution CRT devices.

Existing character display devices use either the character or bit-map method.

FIG. 1 is a block diagram illustrating the configuration of a character-based character display unit. In this figure, a central processing unit (abbreviated as CPU) 1 provides overall system control. A refresh memory (abbreviated as RM) 2 stores character codes, A CRT controller (abbreviated as CRTC) 3 controls CRT display 6 for displaying characters. A character generator (abbreviated as CG) 4 receives character codes and produces pixel signals representing character patterns corresponding to the input character codes. The character generator 4 produces the pixel signals, a set of predetermined number of parallel bits at a time. A parallelserial conversion circuit (abbreviated as PS) 5 converts the parallel bits from the character generator 4 into serial bits. An oscillator circuit 7 (abbreviated as OSC) drives CRT controller 3 and parallel-serial conversion circuit 5.

The following describes the operation of a conventional system, shown in FIG. 1.

The character code written into refresh memory 2 by CPU 1 is read out by CRT controller 3 and sent to character generator 4. Character generator 4 outputs parallel bits representing a character pattern based on this character code. Parallel-serial conversion circuit 5 converts these parallel bits into serial bits. The serial bits are fed to CRT 6 bit by bit, in synchronism with an oscillator circuit 7. Then, CRT 6 displays the resulting data on the display screen. To alter the displayed characters, CPU 1 accesses refresh memory 2 and rewrites the character codes.

FIG. 2 is a block diagram illustrating the configuration of a bit-map character display device. The reference numbers used in FIG. 2 which are identical to those used in FIG. 1 represent the same configuration elements as in FIG. 1. A configuration element in FIG. 2 not present in FIG. 1 is a frame memory (abbreviated as FRM) 8 which has a capacity corresponding to all of the pixels in the display screen of CRT 6 and is used to store the character patterns generated by character generator 4.

The following describes the operation of the conventional system, shown in FIG. 2.

First, CPU 1 accesses character generator 4 and writes one line of character patterns into frame memory 8. Then, CPU 1 accesses character generator 4 again, and writes one line of character patterns for the next line into frame memory 8. By repeating this process as many times as there are lines in a character, the CPU 1 transfers all the character patterns for one character to frame memory 8. CRT controller 3 supplies screen display addresses to frame memory 8. A display signal read from frame memory 8 is converted into serial-bit output by parallel-serial conversion circuit 5 and is sequentially output by oscillator circuit 7 to CRT 6. CRT 6 displays the data thus obtained on the CRT screen.

The character display units of the above configurations are not well suited for use with high-resolution CRTs for the following reasons: In the system using the character method shown in FIGS. 1, refresh memory 2, character generator 4, and parallel-serial conversion circuit 5 must complete their operations within the time it takes for CRT 6 to display a character in a line. Let t be the display time per dot in seconds, and let n be the number of horizontal dots per character; then the display time per character will be tn seconds. Therefore, the extremely small amount of time which the high-resolution CRT allows for the display of a dot has made it difficult to ensure that refresh memory 2, character generator 4, and parallel-serial conversion circuit 5 will complete their operations within the allotted display time per character on that CRT.

As an example, imagine an interlace display mode CRT displaying 2000×2000 dots at 50 Hz. On such a CRT, the cycle time (t) per dot will be:

$$t = 1/(2000 \times 2000 \times 50/2) = 10 \text{ nsec.}$$

On such a CRT, display characters include 24×24 dots each, and including the space between characters will involve 28 dots per character, which translates into a display time of tn=10×28=280 nsec, since n=28.

It is difficult, however, to ensure completion of operations of refresh memory 2, character generator 4, and parallel-serial conversion circuit 5 within that frame of time.

Systems using the bit-map method shown in FIG. 2, in which CPU 1 rewrites characters by transferring the associated character patterns from character generator 4 to frame memory 8, entail a high CPU 1 overhead, and are slower in performing character refreshing than the character method in FIG. 1.

As an example, assume a system with a 16-bit data bus width and with a character configuration of 24×24 dots. To rewrite a character, CPU 1 reads the left 16 bits of the first line of the first character from character generator 4, writing the data into frame memory 8. Then the CPU writes the right 16 bits of the first line into frame memory 8 by a similar process. A character is displayed on the screen by repeating this process through line 24. Thus, to rewrite a character CPU 1 must access character generator 4 48 times and frame memory 8 48 times, for a total of 96 accesses.

By contrast, in the character method of FIG. 1 each character code is stored in refresh memory 2 in 16 bits; given that the data bus width is 16 bits, CPU 1 needs to access refresh memory 2 only once to rewrite a character.

SUMMARY OF THE INVENTION

The present invention is intended to remove the deficiencies of excessive operating time in the character method of displaying information and the difficulty of control and the requirement for expensive hardware in the bit-map method, and to provide a character display device offering simplicity of control and fast character rewrite speeds.

According to the present invention,there is provided a character display device for displaying characters on a display screen of a display means comprising:

a refresh memory for storing character codes for respective display positions on the display screen;

a first control means for sequentially supplying the refresh memory with addresses and thereby causing the refresh memory to sequentially produce character codes;

a character generator responsive to the character codes from the refresh memory for producing pixel signals representing character patterns of the character codes;

a frame memory responsive to the pixel signals from the character generator for storing the pixel signals for display positions of the respective pixels;

a second control means for sequentially supplying the frame memory with addresses and thereby causing the frame memory to sequentially produce pixel signals; and means for causing the display means to display the pixel signals from the frame memory on the display screen.

In the present invention comprised of the above components, first, a character code is written into refresh memory, with the required memory address for refresh memory being generated by the first controller. Then, the output character code corresponding to that memory address is supplied to the character generator, and the character generator outputs a character pattern. Then, the character pattern is written into frame memory according to the address created by the address counter. Input of an address from the second controller into frame memory generates a display signal for use by the display means. After undergoing processing for display, the display signal is displayed on the display means.

Thus, the present invention is capable of solving the above problems and provides a character display device requiring only simple controls and offering fast character rewrite rates.

DETAILED DESCRIPTION OF THE PREFERRED EMBODIMENT

The following describes an embodiment of this invention.

Figure 1:
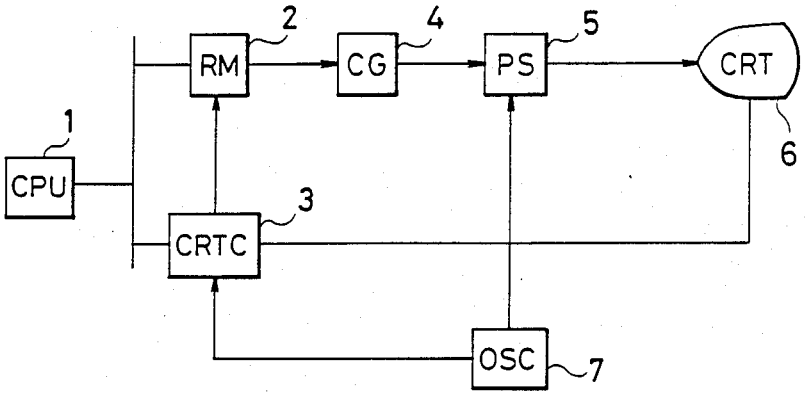
FIG. 1 PRIOR ART
FIG. 1 is a block diagram illustrating the configuration of a character-based character display unit.
Figure 2:
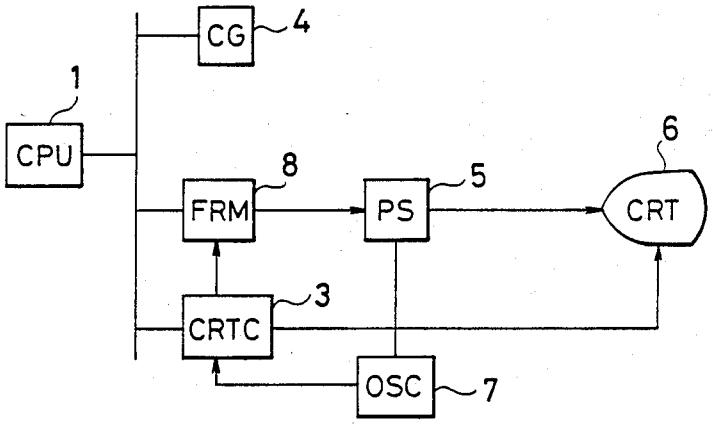
FIG. 2 PRIOR ART
FIG. 2 is a block diagram illustrating the configuration of a bit-map character display device.
Figure 3:
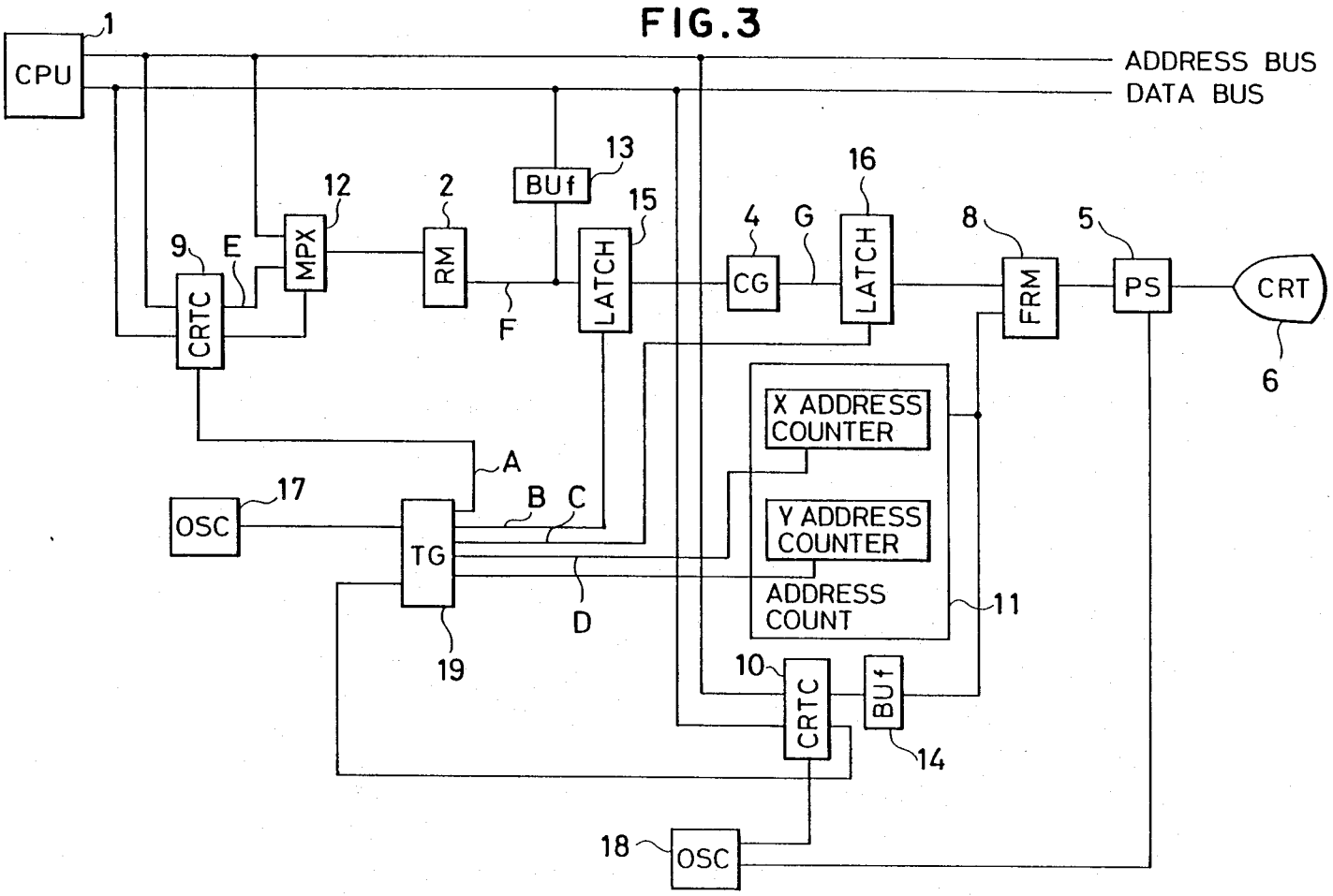
FIG. 3 is a block diagram illustrating an embodiment of the invention.

FIG. 3 is a block diagram illustrating an embodiment of this invention. In this figure, the reference numbers identical to those used in FIGS. 1 and 2 represent the same components as those in FIGS. 1 and 2. Components not shown in FIGS. 1 and 2 are explained below: a CRT controller 9 sequentially generates the memory addresses corresponding to the right-to-left and top-to-bottom positions in refresh memory 3; likewise, a CRT controller 10 sequentially generates the display screen addresses corresponding to the left-to-right and top-to-bottom positions on frame memory 8. An address counter 11 generates the frame memory 8 addresses for the character patterns produced by character generator 4. A multiplexer (abbreviated as MPX) 12 switches the input address bus for refresh memory 2 to either CPU 1 or the CRT controller 9. A bus buffer (abbreviated as BUF) 13 connects the data bus for refresh memory 2 to that for CPU 1, while bus buffer 14 connects the address bus for frame memory 8 to that for CRT controller 10. 15 and 16 are latch circuits, 17 and 18 are oscillator circuits, and 19 is a timing generator (abbreviated as TG) which generates timing signals from a clock provided from oscillator circuit 17.

Figure 4:
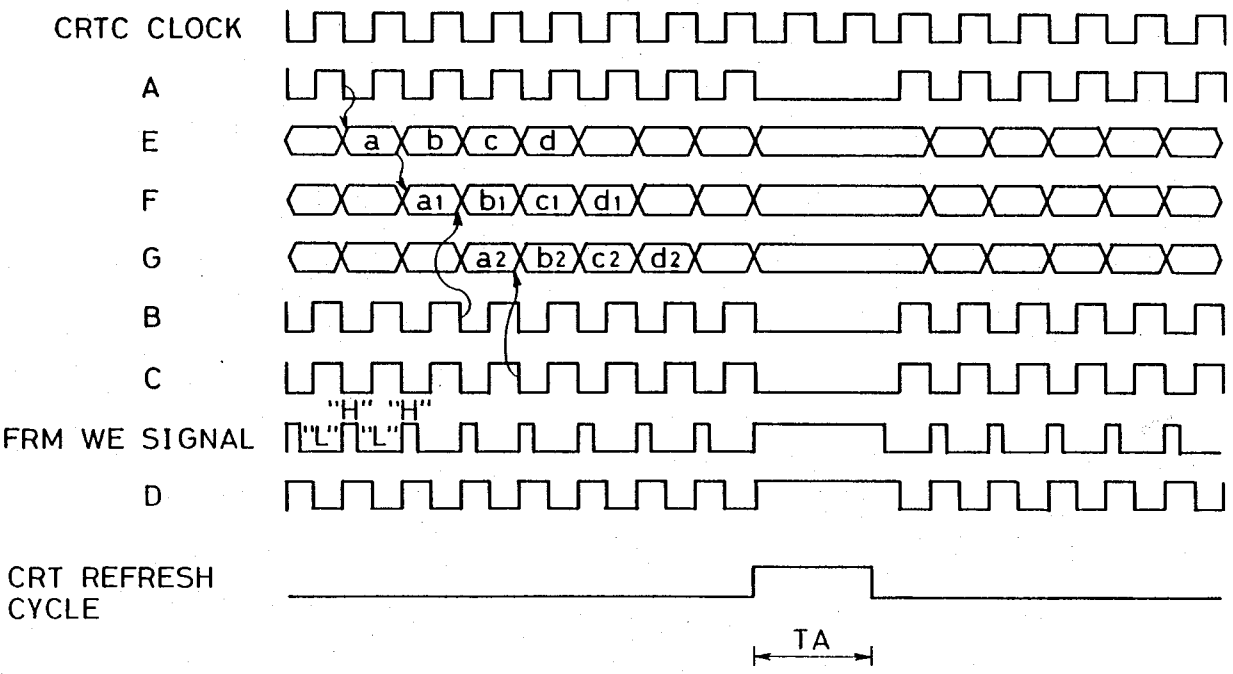
FIG. 4 is a time chart showing the operation of the embodiment of FIG. 3.

The following describes how this embodiment operates in reference to FIG. 3 and FIG. 4, the latter being operation timing charts. It should be noted that the waveforms indicated for signals A through G in FIG. 4 are the signal waveforms at positions A through G in FIG. 3.

CPU 1 writes character codes into refresh memory 2. Multiplexer 12 switches to connect the address bus for refresh memory 2 to the CPU 1 when actual reading from refresh memory 2 is not being made under control of CRT controller 9, i.e., during flyback periods in the process of reading refresh memory 2, and to connect the address bus to the CRT controller 9 when reading is being made, i.e., during the periods other than flyback. Thus, during flyback, CPU 1 writes character codes into refresh memory 2.

As shown in FIG. 4, the timing generator 19 supplies signal A to CRT controller 9. Then, CRT controller 9 outputs signal E, shown in FIG. 4, through synchronization with the CRTC clock signal (shown in FIG. 4). Signal E represents an address for refresh memory 2 which is incremented sequentially from left to right and from top to bottom on the display screen. The address is counted up at the fall of the CRTC clock signal, shown in FIG. 4, and is supplied to refresh memory 2 when multiplexer 12 switches to connect the address bus to CRT controller 9. Then refresh memory 2 outputs the data and character code corresponding to signal F. The character code is then latched by latch circuit 15 at the fall of signal B in FIG. 4.

On the other hand, during access to refresh memory 2 by CPU 1, bus buffer 13 opens up to allow data from refresh memory 2 to be passed to the data bus. The character code latched by latch circuit 15 is supplied to character generator 4. Then, character generator 4 outputs pixel signals G (in parallel) representing the character pattern corresponding to the input character code. Latch circuit 16 latches the pixel signals of this character pattern at the rise and fall of signal C as shown in FIG. 4.

The pixel signals representing a character pattern output from latch circuit 16 are written into frame memory 8, using the "L" level timing of a FRM WE signal shown in FIG. 4, at the address which has been output by address counter 11. Address counter 11 is comprised of an X address counter and a Y address counter. The display screen is expressed in terms of the X, Y-coordinate system. The X address counter indicates addresses in the X direction. Similarly, the Y address counter indicates addresses in the Y direction. Both the X and Y address counters are reset by vertical synchronization signals from CRT controller 9. Also, the X address counter is counted up for each character clock in CRT controller 9. The Y address counter is counted up for each horizontal synchronization signal from CRT controller 9.

In this embodiment frame memory 8 is comprised of graphic dual port memory with built-in serial access memory (abbreviated as SAM). Frame memory 8 reads addresses from CRT controller 10 and outputs signals for CRT display. More specifically, frame memory 8 is given a shift clock with a period equal to "(frame memory 8 output data bus width) multiplied by (1-dot display time)", causing frame memory 8 to send out signals at this clock rate.

The output signals from frame memory 8 are converted by parallel-serial conversion circuit 5 into serial pixel signals at a dot rate required by CRT 6 and are sent to CRT 6.

In the event of a contention between output signals of character generator 4 trying access to the frame memory 8 for writing date therein and access of the frame memory 8 to CRT 6 for display, as described previously, the type of control shown in FIG. 4 for the CRT refresh cycle in interval TA unit is performed. Thus, during display access, by stopping signals A, B, C, and D, the count-up of address for reading from refresh memory 2 by CRT controller 9 can be stopped, the output character code in refresh memory 2 can be latched, the output character pattern from character generator 4 can be latched, and the count-up of address for writing frame memory 8 can be stopped.

In this way, character codes stores in refresh memory 2 are read under control of CRT controller 9, and developed into pixel signals representing character patterns and written in frame memory 8.

As described above, according to this invention, the character codes not suited to use in fast dot-rate display, are developed or extended into frame memory which is capable of high-speed dot rate output. It is therefore possible to display characters on display devices with a fast dot rate. Also, the process of character rewriting devised in this invention, involving only rewriting of character codes in refresh memory by the CPU, lessens the CPU overhead, and makes it possible to execute character displays at a faster rate than is possible with the bit-map method.

What is claimed is:

1. A character display device for displaying characters as pixels on a display screen of a display means operating in accordance with a synchronous signal, comprising:

a refresh memory for storing character codes in their respective display positions on the display screen;

a CPU for accessing said refresh memory and for writing character codes in said refresh memory;

first control means for sequentially supplying said refresh memory with addresses for reading the character codes stored therein, thereby causing said refresh memory to sequentially produce the character codes;

switching means for selectively connecting said refresh memory with one of said CPU and said first control means, so that the addresses for said refresh memory are supplied from said first control means during production of character codes by said refresh memory and are supplied from said CPU during writing of the character codes in said refresh memory;

a character generator responsive to said character codes produced by said refresh memory for producing pixel signals representing character patterns of said character codes;

a frame memory responsive to the pixel signals from said character generator for storing the pixel signals at corresponding write addresses for corresponding display positions for each of the respective pixels of said display screen;

second control means for sequentially supplying said frame memory with read addresses, thereby causing said frame memory to sequentially produce pixel signals; said second control means operating in accordance with said synchronous signal for said display means;

an address counter producing write addresses to said frame memory designating the memory locations of said frame memory at which the pixel signals from said character generator should be written; and means for causing said display means to display the pixel signals produced by said frame memory as pixels on said display screen.

2. A device according to claim 1, further comprising a first latch circuit for receiving the character codes from said refresh memory, said character generator receiving the output of said first latch circuit.

3. A device according to claim 2, further comprising a second latch circuit for receiving the pixel signals from said character generator, said frame memory receiving the output of said second latch circuit.

4. A device according to claim 1, wherein said frame memory produces the pixel signals in parallel, said means for causing display comprising a parallel-to-serial converter for converting the parallel pixel signals from said frame memory into corresponding serial pixel signals.

5. A device according to claim 1, wherein said display means comprises a CRT.

6. A device according to claim 1, wherein said frame memory has a capacity for storing pixel signals corresponding in number to that required for completely filling said display screen of said display means.

7. A device according to claim 1, wherein said second control means operates independently of said first control means.

* * * * *